US009620872B2

(12) United States Patent
Lin

(10) Patent No.: US 9,620,872 B2
(45) Date of Patent: Apr. 11, 2017

(54) MAGNETIC CONNECTOR STRUCTURE

(71) Applicant: Dongguan C.C.P. Contact Probes Co., Ltd., Dongguan, Guangdong (CN)

(72) Inventor: Ching-Yu Lin, Guangdong (CN)

(73) Assignee: DONGGUAN C.C.P. CONTACT PROBES CO., LTD., Dongguan (CN)

( * ) Notice: Subject to any disclaimer, the term of this patent is extended or adjusted under 35 U.S.C. 154(b) by 0 days.

(21) Appl. No.: 13/861,815

(22) Filed: Apr. 12, 2013

(65) Prior Publication Data

US 2014/0011375 A1 Jan. 9, 2014

(30) Foreign Application Priority Data

Jul. 9, 2012 (CN) ..... 2012 1 0234999

(51) Int. Cl.
*H01R 11/00* (2006.01)
*H01R 11/30* (2006.01)
*H01R 13/62* (2006.01)

(52) U.S. Cl.
CPC ..... *H01R 11/30* (2013.01); *H01R 13/6205* (2013.01)

(58) Field of Classification Search
CPC ..... H01R 11/30; H01R 13/6025
USPC ..... 439/39, 188
See application file for complete search history.

(56) References Cited

U.S. PATENT DOCUMENTS

| | | | | |
|---|---|---|---|---|
| 6,623,276 | B2 * | 9/2003 | Dalmau Ferrerfabrega et al. | 439/39 |
| 6,808,405 | B1 * | 10/2004 | Uratani et al. | 439/188 |
| 7,445,452 | B1 * | 11/2008 | Wu | 439/39 |
| 2010/0003842 | A1 * | 1/2010 | Wang et al. | 439/188 |

* cited by examiner

*Primary Examiner* — Phuong Dinh
(74) *Attorney, Agent, or Firm* — Ming Chow; Sinorica, LLC

(57) ABSTRACT

The invention relates to a magnetic connector, in particular to a structure for placing a magnet therein. In order to make the design on the size of the magnet free from the restraint on the standard of connection surfaces, a magnetic connector structure is provided. The magnetic connector structure is provided with a connection surface, conductive terminals (2), an inner cavity and a magnet (6), the connection surface comprising a terminal area and a magnetic area, wherein the magnet (6) is arranged in an inner cavity (10), and a magnetic conductive block is further provided for conducting the magnetic force of the magnet (6) to the magnetic area.

7 Claims, 1 Drawing Sheet

MAGNETIC CONNECTOR STRUCTURE

TECHNICAL FIELD OF THE INVENTION

The invention relates to a magnetic connector, in particular to a structure for placing a magnet therein.

BACKGROUND OF THE INVENTION

There have been structures for avoiding two paired connectors being disconnected after connected by magnetic force. For example, the connection surface of a female connector comprises a terminal area and a magnetic area, the magnetic area is provided with a magnet, and a male connector is provided with an iron shell. The male connector and the female connector are in the connected state when the conductive terminals thereof contact with each other. At this time, the connection surfaces of the male connector and the female connector are fitted with each other, the portion of the iron shell located on the connection surface contacts the magnet, so that the iron shell is adsorbed by the magnet, in this way, the male and female connectors are unlikely to disconnect from each other. In order to dispose an N pole and an S pole at different positions on the connection surface, at least two magnets, of which one is used as the N pole on the connection surface while the other is used as the S pole on the connection surface, are required.

The portion of the connection surfaces of connectors is required to be standardized in industrialized production, and the length and width of the connection surface and the arrangement of conductive terminals are strictly restricted in design by relevant standards. For magnetic connectors, when the magnetic force is to be enhanced, the design on the size of magnets will get into trouble due to the restraint on the standard of connection surfaces.

Some one has attempted to put the magnet in the inner cavity of a female connector by using the magnetic conduction property of the conductive terminals themselves. The magnet conducts the magnetic force by the conductive terminals of the female connector to adsorb the conductive terminals of the male connector, no magnetic area needs to be additionally remained on the connection surface of the female connector, and the corresponding male connector does not need to be provided with any iron shell for being attracted by the magnet. With such structure, because the magnet is arranged in the inner cavity of the female connector, the design on the size of the magnet is free from the restraint on the standard of connection surfaces. However, other problems will be caused:

(1) in order to get good magnetic conduction effect, the conductive terminals of the female connector are required to close to the magnet, in this case, the conductive terminals are likely to be in short circuit due to the magnet;

(2) the magnetic conduction effect is poor and the adsorption is infirm due to the small contact surface of the conductive terminals;

(3) the conductive terminals are used for both electric conduction and magnetic conduction; in this case, it is difficult to select materials to manufacture the conductive terminals.

SUMMARY OF THE INVENTION

The invention aims to provide a magnetic connector structure, with such structure, the design on the size of the magnet is free from the restraint on the standard of connection surfaces, and the three problems set forth above are unlikely to be caused.

For this purpose, a magnetic connector structure is provided. The magnetic connector structure is provided with a connection surface, conductive terminals, an inner cavity and a magnet. The connection surface comprises a terminal area and a magnetic area, wherein the magnet is arranged in the inner cavity, and a magnetic conductive block is further provided for conducting the magnetic force of the magnet to the magnetic area.

The design on the size of the magnet is free from the restraint on the standard of connection surfaces because the magnet is arranged in the inner cavity. Furthermore, (1) the conflict between improvement of the magnetic conduction effect and short circuit of the conductive terminals due to the magnet is avoided;

(2) the magnetic conduction effect and the adsorption effect are free from the size of the contact area of the conductive terminals;

(3) the magnetic conduction function is not required by the conductive terminals, the electric conduction function is required by the magnetic conductive block, and the availability of material is high.

To dispose an N pole and an S pole on different positions on the connection surface, with the use of the magnetic conductive block for conducting the magnetic force to the magnetic area, only one magnet instead of two magnets is required at least.

DETAILED DESCRIPTION OF THE INVENTION

In the embodiments, the fitted male and female connectors are magnetic connectors.

Figure 1:
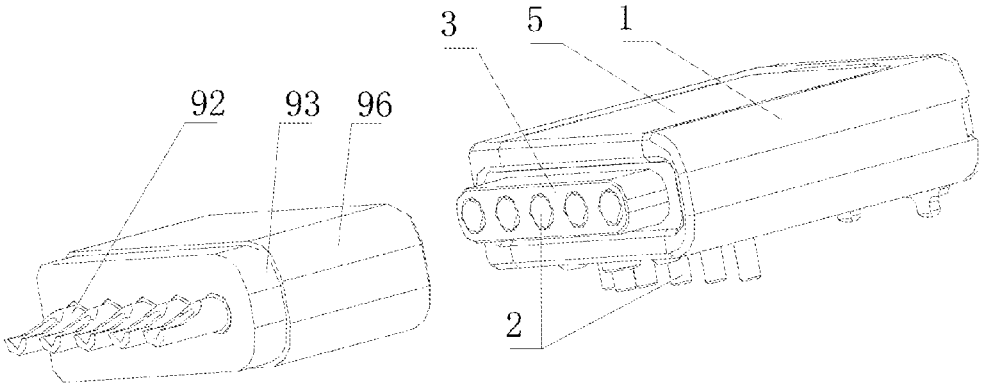
FIG. 1 is a fitting position schematic diagram of a male connector and a female connector.

The male connector is as shown in FIG. 1, and the conductive terminals 92 are arranged in the iron shell 96 by plastic parts 93.

Figure 2:
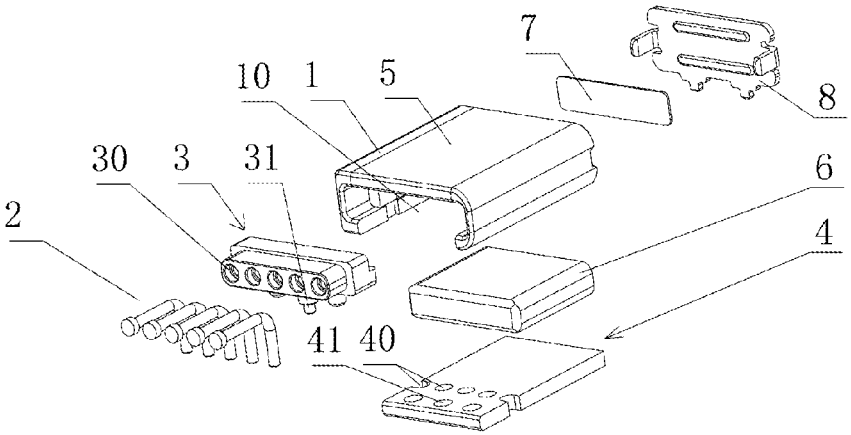
FIG. 2 is an exploded view of the female connector.

The female connector is as shown in FIG. 1 and FIG. 2, specifically described as follow.

A plurality of conductive terminals 2 is fixed in an electrically insulated form by fixers, each fixer comprises a plastic member 3 and a composite member 4, and an assembly pin 31 of the plastic member 3 is assembled in an assembly hole 41 at the front part of the composite member 4. The head ends of the conductive terminals 2 protrude from a pin hole 30 of the plastic member 3 and expose in the terminal area of the connection surface, and the tail ends of the conductive terminals 2 protrude from the pin hole 40 in the middle of the composite member 4. The composite member 4 is formed of a magnetic conductive block coated with an insulating material layer on the surface thereof, in particular, the surface of the pin hole 30 must have excellent insulating property, and otherwise, the plurality of conductive terminals 2 will be in short circuit due to the magnetic conductive block. Hereinafter, the magnetic conductive block is called lower magnetic conductive block. Electric insulation is accomplished by fixers between the conductive terminals 2, between the magnetic conductive block and the conductive terminals 2, and between the magnet 6 and the conductive blocks 2.

The magnet 6 is arranged in an inner cavity 10 surrounded by a shell 1, an upper magnetic conductive block 5 and the composite member 4. The upper and lower magnetic conductive blocks conduct the magnetic force of the magnet to the magnetic area. The upper magnetic conductive block 5 is arranged on the shell 1, with its inner surface contacting the upper surface of the magnet, and the front end face of the upper magnetic conductive block 5 is located in the magnetic area of the connection surface of the female connector; and the lower magnetic conductive block is as described above, with its surface coated with an insulating material layer. Good magnetic conduction and adsorption effects may be obtained if the front end face of the magnetic conductive block is arranged in the magnetic area of the connection surface and the magnetic conductive block contacts the magnet 6. The upper and lower sides of the female connector are large while the left and right sides are small. The magnetic conductive blocks are arranged at the large upper and lower sides, so that the magnetic conduction effect is good.

The connection surface is arranged in front of the magnet 6, and the magnetic conductive blocks are arranged above and below the magnet 6. Therefore, electric elements arranged at the left, right and back sides of the magnet 6 outside the female connector are likely to suffer magnetic disturbance. In the embodiments, a magnetic shield plate 8 is arranged behind the magnet 6 in order to avoid the magnetic disturbance. Further, in order to avoid lines of magnetic force from short circuit caused by the contact between the magnetic shield plate 8 and the magnet 6, a non-magnetic conductor 7 is especially provided for partitioning the magnet 6 from the magnetic shield plate 8. The non-magnetic conductor 7 may be a layer of polyester thin film.

In the embodiments, the conductive terminals 2, the plastic member 3, the front part and middle part of the composite member 4, the front end face of the shell 1, and the front end face of the upper magnetic conductive block 5 are all associated with the standard of connection surfaces, all need to be designed according to the standard of connection surfaces. But the design on the inner cavity 10, the back part of the composite member 4, the magnet 6, the back part of the shell 1, the back part of the upper magnetic conductive block 5, the non-magnetic conductor 7 and the magnetic shield plate 8 is free from the restraint on the standard of the connection surfaces.

What is claimed is:

1. A magnetic connector structure comprising:
a connection surface;
the connection surface comprising a terminal area and a magnetic area;
a plurality of conductive terminals;
an inner cavity;
a magnet;
the magnet being arranged in the inner cavity;
at least a first magnetic conductive block;
the at least one first magnetic conductive block being arranged so as to conduct magnetic force of the magnet to the magnetic area;
the plurality of conductive terminals being all electrically insulated from the magnet and from the at least first magnetic conductive block;
a magnetic shield plate; and
the magnetic shield plate being arranged on at least one non-connection surface.

2. The magnetic connector structure according to claim 1 further comprising:
a plastic member;
a composite member;
the composite member comprising the first magnetic conductive block and an insulating material layer;
the insulating material layer being arranged on a surface of the first magnetic conductive block; and
the plurality of conductive terminals being electrically insulated from the magnet and from the at least first magnetic conductive block by the plastic member and by the insulating material layer.

3. The magnetic connector structure according to claim 1 further comprising the at least first magnetic conductive block being arranged at a large side of the magnetic area.

4. The magnetic connector structure according to claim 1 further comprising a front end face of the at least first magnetic conductive block located in the magnetic area of the connection surface.

5. The magnetic connector structure according to claim 1 further comprising the magnet contacting the at least first magnetic conductive block.

6. The magnetic connector structure according to claim 1 further comprising a non-magnetic conductor being arranged between the magnet and the magnetic shield plate.

7. The magnetic connector structure according to claim 1 further comprising the magnetic shield plate being arranged behind the magnet, opposite the connection surface.

* * * * *